United States Patent [19]

Meirowitz et al.

[11] Patent Number: 4,822,454

[45] Date of Patent: Apr. 18, 1989

[54] ENHANCED SOIL REMOVAL FROM PAPER MACHINE FORMING FABRICS

[75] Inventors: Randy E. Meirowitz, Medford; Charles E. Kramer, Walpole, both of Mass.

[73] Assignee: Albany International Corp., Dedham, Mass.

[21] Appl. No.: 946,448

[22] Filed: Dec. 24, 1986

[51] Int. Cl.[4] ..... D21F 1/32

[52] U.S. Cl. ..... 162/199; 162/274; 15/21 B; 15/21 R; 15/302; 15/308

[58] Field of Search ..... 162/199, 274, 272; 15/21 B, 21 R, 308, 302

[56] References Cited

U.S. PATENT DOCUMENTS 4,556,453 12/1985 Meinecke ..... 162/274

FOREIGN PATENT DOCUMENTS 0053316 9/1982 European Pat. Off. ..... 162/274

*Primary Examiner*—David L. Lacey
*Assistant Examiner*—Thi Dang
*Attorney, Agent, or Firm*—Kane, Dalsimer, Sullivan, Kurucz, Levy, Eisele and Richard

[57] ABSTRACT

This invention relates to the removal of soil from paper machine forming fabrics. More particularly, this invention is directed to a method and apparatus for removing contaminants from forming fabric in a papermaking machine wherein the forming fabric moves in a longitudinal direction, the apparatus includes a set of bristles having upper and lower ends and arranged above the forming fabric, the lower ends of the bristles being in contact with the upper surface of the forming fabric and the upper ends of the bristles being engaged by a bristle holder, the bristle holder being supported by a support device and the bristles being comprised of a lower surface energy material oleophilic to polyester at a water-/oil interface.

20 Claims, 1 Drawing Sheet

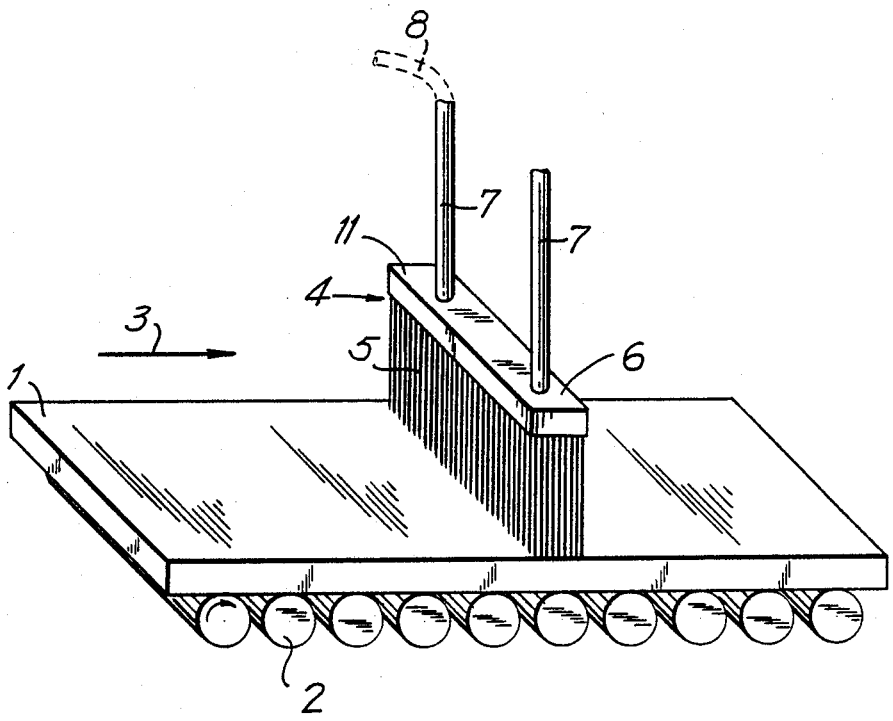
8
7
7
11
4
3
5
6
1
2

ENHANCED SOIL REMOVAL FROM PAPER MACHINE FORMING FABRICS

FIELD OF THE INVENTION

This invention is directed to the removal of soil from paper machine forming fabrics. More particularly, this invention is directed to a system for the enhanced removal of contaminants from a forming fabric on a papermaking machine.

BACKGROUND OF THE INVENTION

During the formation of paper in a papermaking machine, the forming fabric from which the paper is formed tends to become contaminated. There are presently several different methods in use for removing such contaminants. For example, brushes and/or high pressure showers are used in the sheet side of the forming fabric, the intent being to remove deposited contaminants by mechanical shearing action.

Various methods and devices are known for cleaning moving surfaces. For example, U.S. Pat. Nos. 1,161,806, 2,633,779, 3,041,833, and 4,556,453 are directed to arrangements for cleaning rollers and screen belts on papermaking machines. None of these references, however, is directed to the removal of contaminants from the forming fabric itself. Similar arrangements are shown in U.S. Pat. Nos. 4,407,219 and 4,090,445 for a fuser roller in an electrostatic copy machine and an impression cylinder in a fabric printing machine, respectively.

The cleaning of material on a roll is shown in U.S. Pat. Nos. 2,551,601 and 2,648,088. According to the '601 patent, the gelatin film on the copying roll of a duplicating machine is cleaned with an elongated sponge member held in an elongated U-shaped holder, the cleaning apparatus being fluidly connected to a liquid reservoir. The '088 patent describes the cleaning of an endless waterproof blanket for printing textiles by applying solvent to bristles on a cylindrical roller, which bristles are then contacted with the textile printing blanket.

OBJECTS OF THE INVENTION

It is an object of the invention to provide for a method and apparatus for soil removal from paper forming fabric.

It is also an object of the invention to provide a method and apparatus for the enhanced removal of contaminants from forming fabrics for a papermaking machine.

These and other objects of the invention will become more apparent in the description below.

BRIEF DESCRIPTION OF THE DRAWING

The Figure represents an oblique view of a portion of a papermaking machine wherein a portion of the forming fabric is being treated according to the invention.

DETAILED DESCRIPTION OF THE INVENTION

Applicants have surprisingly found a method of removing contaminants from forming fabrics used on a papermaking machine which is much more effective than methods presently in use. According to Applicants' invention, contaminants are removed by means of a bristle material which, at a water/oil interface, is oleophilic relative to polyester. A non-forming aqueous surfactant solution may optionally be present.

The brushes should be arranged so that the brushes do not move in the direction of the movement of the surface of the paper machine forming fabric as the paper machine forming fabric is processed. For example, one or more brushes arranged perpendicular to the direction of movement of the paper forming fabric could be fixed or moving back and forth across the paper forming fabric as the paper forming fabric is moved beneath them. In the alternative, the bristles could be positioned on rotating brush members that would extend across the paper machine forming fabric so that each axis of rotation would be perpendicular to the movement of the paper forming fabric and that would rotate in a direction opposite to the movement of the paper forming fabric, that is, at the points of contact the brushes would be moving against the movement of the paper forming fabric.

Selection of the bristle material is highly important. The bristle material must be low surface energy material that is oleophilic relative to polyester, at a water/oil interface. Examples of suitable materials include polypropylene, polyethylene, and fluoropolymers, such as fluorinated ethylene propylene (FEP), and copolymers thereof with polyethylene terephthalate. The bristles can be from about 1 to 6 cm, preferably from about 2 to 5 cm, in length and can have an o.d. of from about 30 to 65 mils, preferably from about 35 to 45 mils. Also, the bristles, which can be either solid or hollow, are arranged in a substantially parallel fashion in density or spacing as presently applied and known in the art.

Various surfactant systems known in the art could be used. For example, a useful non-foaming aqueous surfactant solution could comprise from about 1% to 95%, preferably from about 2% to 10%, of one of various surfactants available under the name of TRITON® from Rohm & Haas Co. Such surfactants include TRITON CF 10, TRITON CF 21, and TRITON CF 87, which comprise non-ionic surfactants based on alkylaryl polyether alcohols; TRITON CF 32, which comprises a nonionic amine polyglycol condensate; TRITON CF 54 and TRITON CF 76, which comprise non-ionic modified polyethoxy adduct; TRITON DF 12, TRITON DF 16, and TRITON DF 18, which comprise non-ionic modified polyethoxylated alcohol; and TRION DF 20, an anionic modified ethoxylate. It is advantageous that the surfactant systems be applied as slow as possible, such as at a rate of from about 0.1 to 2 ml/min, preferably from about 0.2 to 1.8 ml/min., per linear ft. of forming fabric surface perpendicular to the movement of said surface.

If a surfactant solution is employed, the surfactant system could be supplied to the bristles in a number of ways. For example, the surfactant solution could be supplied, optionally under pressure, to the member holding the bristles, the bristle holding member having holes through which the surfactant solution would drop or move to the bristles themselves and thus to the paper forming fabric. Such movement of the surfactant solution would be due to capillary action between the bristles and/or the movement of the bristles across the surface of the paper forming fabric. In an alternate embodiment, some or all of the bristles themselves may be hollow and in fluid connection with the bristle holding member such that non-foaming surfactant solution moves from the proximal ends of the hollow monofilament bristles to the distal ends via capillary action within the hollow bristles. In hollow bristles the void or "hollowness" would comprise from about 5 to 80%, preferably from about 10 to 70%, of the cross-sectional area.

The invention herein can perhaps be better appreciated by making reference to the drawing. In the drawing, paper machine forming fabric 1 passes over rollers 2 in the direction shown by arrow 3, rollers 2 rotating in clockwise direction. Cleaning apparatus 4 comprises bristles 5 held by bristle holder 6. Bristle holder 6 is moved in a back and forth motion perpendicular to arrow 3 by supports 7.

Surfactant solution can be supplied to bristles in several different ways. The surfactant solution can be supplied through one or more supports 7 by means of hose 8 to bristle holder 6, from which the surfactant solution would travel through holes (not shown) in the bottom of holder 6 to bristles 5 and then the surface of forming fabric 1. In another aspect of the invention, the bristles 5 are hollow and the surfactant solution travels within the bristles to the surface of the forming fabric via capillary action. A further variation is that the surfactant solution is either applied directly to the bristles 5 or is applied to the surface of the forming fabric 1 just before the surface contacts the bristles.

Contaminants removed from the forming fabric first adhere to the bristles. The contaminants can be removed from the bristles by an active procedure in which after a sufficient period of operation the bristles either are merely replaced or are removed, combed out, and reinstalled. In an alternate, passive procedure, the contaminants accumulate or build up on the bristles until particles of the contaminants fall off into suitable receptacles. For example, a drip pan may be located to the rear of, or on the back of, the bristles to "catch" such particles.

The preceding specific embodiments are illustrative of the practice of the invention. It is to be understood, however, that other expedients known to those skilled in the art or disclosed herein, may be employed without departing from the spirit of the invention or the scope of the appended claims.

We claim:

1. A combination of a forming fabric and a forming fabric contaminant removal apparatus, said apparatus comprising a set of bristles having upper and lower ends and arranged above the forming fabric, the lower ends of said bristles being in contact with an upper surface of the forming fabric and the upper ends of said bristles being engaged by a bristle holder, the bristle holder being supported by a support means and said bristles being comprised of a lower surface energy material oleophilic relative to said forming fabric at a water and oil interface, the material being selected from the group consisting of polyolefins, fluoropolymers, and copolymers thereof with polyethylene terephthalate.

2. The combination of claim 1, wherein the bristles are from about 1 to 6 cm in length.

3. The combination of claim 2, wherein the bristles are from about 2 to 5 cm in length.

4. The combination of claim 1, wherein the bristles have an outside diameter of from about 30 to 65 mils.

5. The combination of claim 4, wherein the bristles have an outside diameter of from about 35 to 45 mils.

6. The combination of claim 1, wherein the bristle material is a fluoropolymer and the fluoropolymer is fluorinated ethylene proplyene.

7. The combination of claim 1, wherein the bristles are hollow.

8. The combination of claim 1, wherein said support means is constructed to move said bristle holder in a back and forth motion perpendicular to said upper surface of said forming fabric.

9. The combination of claim 1, wherein said forming fabric moves in a first direction and said support means has means for rotating said bristles in a second direction such that said bristles in contact with the upper surface of the forming fabric move opposite to said first direction.

10. The combination of claim 1 which also comprises a liquid supply means arranged to supply aqueous surfactant solution to said bristles so that said aqueous surfactant solution travels along said bristles to the upper surface of the forming fabric.

11. A method for removing contaminants from forming fabric comprised of polyester or other material having similar surface energy in the wet end of a papermaking machine, wherein the forming fabric having an upper surface which moves in a longitudinal direction, which comprises (i) contacting said upper surface with bristles comprised of a lower surface energy material oleophilic relative to said forming fabric at a water and oil interface, the material being selected from the group consisting of polyolefins, fluoropolymers, and copolymers thereof with polyethylene terephthalate, to cause the contaminants to adhere to said bristles and (ii) removing said contaminants from said bristles.

12. The method of claim 11, wherein the bristles are from about 1 to 6 cm in length.

13. The method of claim 12, wherein the bristles are from about 2 to 5 cm in length.

14. The method of claim 11, wherein the bristles have an outside diameter of from about 30 to 65 mils.

15. The method of claim 14, wherein the bristles have an outside diameter of from about 35 to 45 mils.

16. The method of claim 11, wherein the bristle material is a fluoropolymer, and the fluoropolymer is fluorinated ethylene propylene.

17. The method of claim 11, wherein the bristles are hollow.

18. The method of claim 11, wherein said bristles are moved in a back and forth motion perpendicular to said longitudinal direction.

19. The method of claim 11, wherein said bristles are rotated in a direction such that said bristles in contact with the upper surface of the forming fabric are moving opposite to said longitudinal direction.

20. The method of claim 11, wherein aqueous surfactant solution is supplied from a liquid supply means to said bristles so that said aqueous solution travels along said bristles to the upper surface of the forming fabric.

* * * * *